United States Patent [19]

Felix et al.

[11] 4,326,620

[45] Apr. 27, 1982

[54] SECURITY PYLON FOR A VENDING MACHINE

[75] Inventors: Cristian J. Felix, Flushing, N.Y.; Donald M. Genaro, Haworth, N.J.

[73] Assignee: PepsiCo Inc., Purchase, N.Y.

[21] Appl. No.: 112,170

[22] Filed: Jan. 15, 1980

[51] Int. Cl.[3] ..... G07F 9/02

[52] U.S. Cl. ..... 194/1 A; 221/3

[58] Field of Search ..... 194/1 A, 1 B, 1 F, DIG. 10, 194/DIG. 14; 221/3, 154, 281; 232/15, 16

[56] References Cited

U.S. PATENT DOCUMENTS

| | | | |
|---|---|---|---|
| 2,858,921 | 11/1958 | Fry | 194/DIG. 14 |
| 3,016,185 | 1/1962 | Osborne | 232/15 |
| 3,083,896 | 4/1963 | Cairelli et al. | 232/15 |
| 3,178,055 | 4/1965 | Schuller | 221/75 |
| 3,852,737 | 12/1974 | Gordon | 221/3 |

*Primary Examiner*—F. J. Bartuska

*Attorney, Agent, or Firm*—Scully, Scott, Murphy & Presser

[57] ABSTRACT

An improved design for a vending machine is disclosed wherein the cash receipts and coin dispensing mechanisms of the machine are stored within a separate internal security pylon. The front exterior panel of the machine is pivotable relative thereto by a piano hinge to allow access to the interior of the machine for service operations, and is provided with a first lock. Opening of the front outer door allows access to a security pylon mounted behind and on the interior of the front panel which is provided with a second lock. The monetary contents of the machine are stored within the security pylon so that the cash stored therein can be removed only after successively opening the first and second locks.

7 Claims, 5 Drawing Figures

SECURITY PYLON FOR A VENDING MACHINE

BACKGROUND OF THE INVENTION

1. Field of the Invention

The present invention relates generally to an improved design for a vending machine, and more particularly pertains to a vending machine which is designed to minimize problems caused by theft of the monetary receipts and dispensing coins stored therein. In greater particularity, the present invention relates to a design for a vending machine having an internal security pylon for storage of all cash receipts and coin dispensing functions.

2. Discussion of the Prior Art

Vending machines of products such as soft drinks are often subjected to incidents of theft and vandalism. Machines of this nature are often accessible to potential thieves and vandals twenty-four hours a day at locations which provide an opportunity for potential theft of the cash receipts of the machine without affording assurances that the thieves will be noticed or apprehended.

Vending machines of the type discussed herein have been provided with a locked cash receipts box which is accessible from the exterior of the machine by authorized personnel having a key to unlock the container. The presence of a cash receipts box accessible from the exterior of the machine occasionally presents a temptation to a thief to attempt to jimmy it open with a crowbar or other appropriate instrument, or to attempt to break the lock by subjecting it to blows directly from a hammer or by directing a chisel or screwdriver at the lock tumblers. Accordingly, arrangements of this nature have frequently been unsatisfactory, as even if they withstand the physical abuse of the attempted theft, the vending machine was often subjected to a considerable amount of damage and abuse, requiring servicing and repair of the machine. Of course, if the thief were successful in jimmying open the cash box, the success served to provide an inducement for future acts of theft and destruction against other vending machines.

Another type of security arrangement for a vending machine which has been provided in the art includes an arrangement wherein the cash box is accessible only by gaining access to the interior of the vending machine, typically by opening a front door panel which is also normally locked. Larcenous efforts directed at this type of vending machine included attempts to jimmy open the door of the machine, usually through the use of a crow or prybar, or attempts to destroy the lock securing the door. Attempts of this nature, even is unsuccessful, often resulted in a considerable amount of damage and abuse to the machine. Furthermore, arrangements of this nature are subject to theft from dishonest personnel who legitamately have a key to the outer door of the machine for selected authorized purposes, but who use the key in an unauthorized manner to gain access to the cash box for larcenous purposes. Furthermore, occasionally a key to the machine might fall into the possession of unauthorized persons who would use it illegally to gain access to the machine and empty the cash box and coin dispenser therein of their contents.

SUMMARY OF THE INVENTION

Accordingly, a primary object of the present invention is to provide a dispensing machine which is designed to store the monetary contents thereof in a more secure manner than is available in known prior art arrangements.

Another object of the present invention is the provision of a vending machine wherein the monetary contents of the machine, including the cash receipts and coin dispenser therefor, are located in a security pylon internally of the machine.

Another object of the present invention is to provide a vending machine wherein access to its cash contents may be gained only by authorized personnel having two different keys, a first key to open an outer door of the vending machine thereby providing access to the interior of the machine, and a second key providing access to a security pylon internally of the machine which encloses the stored monetary or cash contents of the machine.

In accordance with a preferred embodiment herein, an improved design is provided for a vending machine wherein the monetary contents of the machine are stored in a security pylon. An outer door for the vending machine is provided on one of its exterior walls to allow access to the interior of the machine for service operations, with the outer door being provided with a first lock. Opening of the outer door provides access to a security pylon on the interior of the vending machine which is provided with a second lock. The monetary contents of the machine is stored within the security pylon so that the cash receipts of the vending machine can be removed only after successively opening the first and second locks.

In a preferred embodiment of the invention, the front exterior wall of the vending machine forms the outer door, and is pivotable relative to the machine by a piano hinge. The security pylon is mounted behind and on the interior of the front outer door, and the rear panel of the pylon is pivotably openable relative to the pylon by a second piano hinge. The first lock is accessible on an exterior portion of the front panel, and the second lock is provided on the rear panel of the pylon and is accessible only after opening of the front panel. Furthermore, the security pylon is positioned laterally off to one side of the vending machine, and the coin deposit and coin dispensing mechanisms are provided in the pylon on one side of the front panel of the machine.

Also in the preferred embodiment, the coin handling unit is mounted on the interior surface of the pylon rear panel door and is pivotably movable therewith. A coin chute and a coin return toggle mechanism are mounted in the security pylon above the coin handling unit when the pylon door is closed, and cooperate therewith respectively to deposit coins in the unit and actuate its coin return function. A coin return chute and coin collection depository are mounted in the security pylon below the coin handling unit when the pylon door is closed, and cooperate therewith respectively to return coins to a change hopper on the front panel of the machine and accumulate the cash receipts thereof.

The exterior housing of the vending machine and the interior security pylon are both constructed of sheet metal steel, and the gauge of the sheet steel from which the pylon is constructed is thicker than the gauge of the steel from which other portions of the housing of the vending machine are constructed.

The security pylon is provided with case to door overlap along the top and bottom edges of the pylon door to prevent the leverage of a tool such as a crowbar acting to gain unauthorized access thereto. Furthermore the vending machine may incorporate an audio and/or visual alarm which is activated in the event that either the outer door or the security pylon is breached in an unauthorized fashion. The alarm may be designed with a power supply which is not interrupted in the event the vending machine is unplugged from an AC wall outlet. In this regard, the power supply may be a separate battery pack or a rechargable battery pack which is periodically recharged by the AC voltage supply to the machine. Triggering of an audio alarm by an unauthorized opening of the outer door of the vending machine is particularly advantageous as the alarm would discourage potential thieves from pursuing further attempts to open the security pylon while the audio alarm is sounding.

BRIEF DESCRIPTION OF THE DRAWINGS

The foregoing and other objects and advantages of a novel vending machine constructed pursuant to the teachings of the present invention may be more readily understood by one skilled in the art having reference to the following detailed description of a preferred embodiment thereof, taken in conjunction with the accompanying drawings wherein identical reference numerals are utilized to refer to like elements throughout the several views, and in which.

DETAILED DESCRIPTION OF THE DRAWINGS

Figure 1:
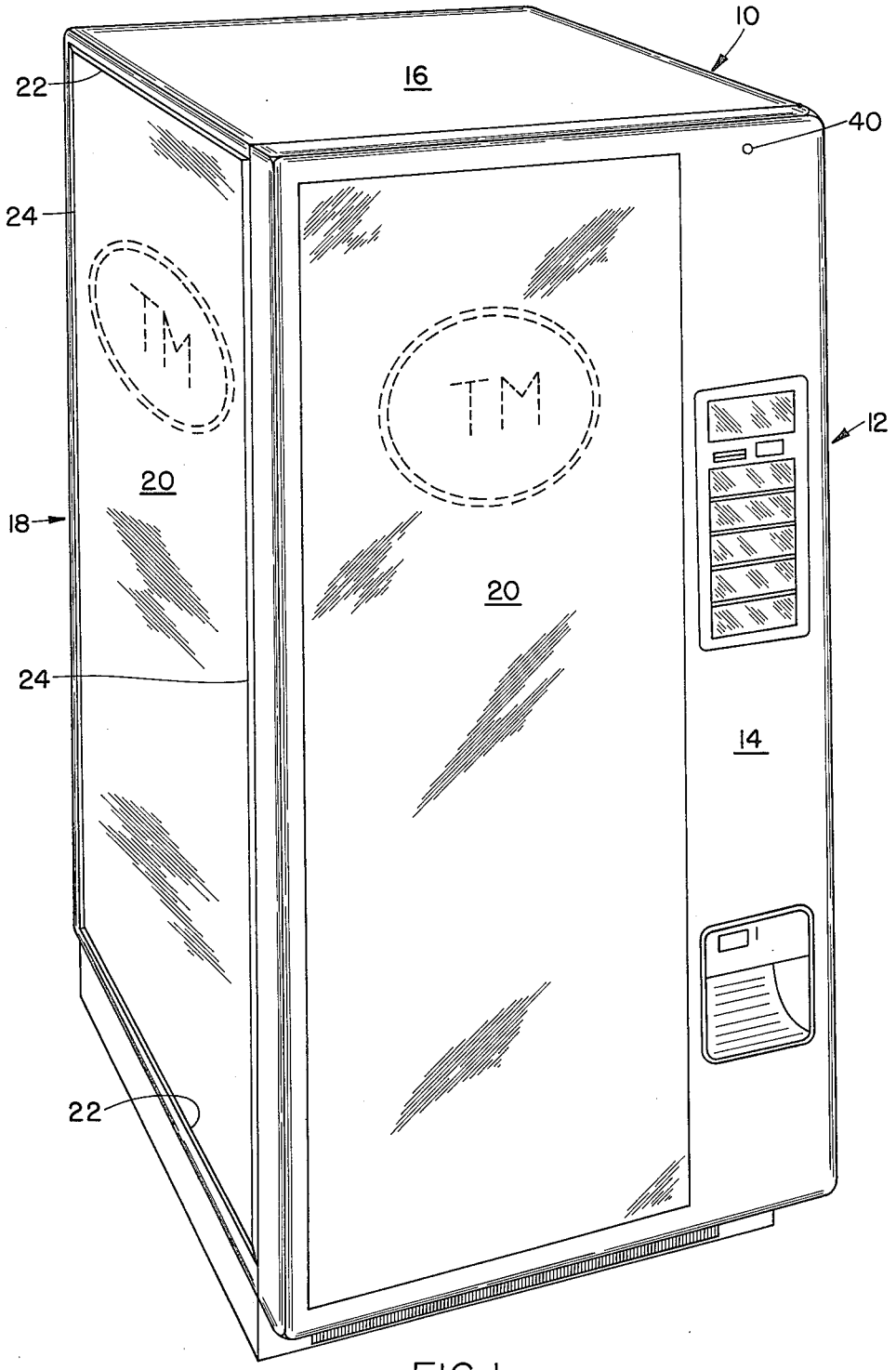
FIG. 1 is a frontal perspective view of a vending machine for soft drinks constructed pursuant to the teachings of the present invention.

Referring to the drawings in detail, FIG. 1 illustrates a vending machine 10 of the type, for example, which may dispense containers of soft drinks. The vending machine may incorporate contructional features as taught in copending U.S. patent application Ser. No. 112,172 entitled VENDING MACHINE WITH COMMON PANEL STRUCTURE, filed Jan. 15, 1980, and furthermore the front selection panel 12 for the machine may be constructed in accordance with the teachings of copending U.S. patent application Ser. No. 152,523 entitled CAPACITIVE SWITCHING PANEL, filed May 22, 1980, both assigned to the common assignee of this application.

In accordance with the teachings of the latter patent application, an improved selection panel incorporates touch actuated capacitive selection switches, and provides a facility to readily change the visible indicia indicating the nature of the selection provided by each switch. The touch actuated capacitive switches are formed on a common transparent glass substrate having first and second transparent conductive coatings on opposite sides thereof. The glass substrate has a common conductive coating on one side, and a plurality of discrete separate conductive coated areas on its opposite side forming the separate capacitive switches. An opaque delineation pattern may be provided on the substrate to provide a visible separation of the different areas of the several switches. A common frame for the indicia associated with each switch is positioned behind and adjacent to the coated substrate. A removable rectangular paper indicia tab is provided for each capacitive switch, and is positioned in the frame adjacent to the coated substrate such that the indicia is visible therethrough and indicates the nature of the switching function. The common frame provides opposed U-shaped slots on opposite sides of each capacitive switch, such that the rectangular paper tab is slideable between a pair of opposed slots.

The arrangement illustrated in FIG. 1 is such that the functional items required on the front surface 14 of the dispensing machine, such as coin handling and dispensing, product information, product selection and dispensing, etc., are provided on the right portion of the front surface. The top surface 16, rear surface and side surfaces 18 of the vending machine are normally constructed primarily of sheet metal, although other types of materials could also be used in alternative embodiments. The portion of the front panel surrounding the functional items on the right side thereof and surrounding a front decorative panel 20 are also constructed of sheet metal in a typical fashion. Side decorative panels 20, identically sized with the front panel, are mounted on the side surfaces of the machine. All of the decorative panels are identically decorated with trademark or product identification indicia, or simply with aesthetic decorations. The decorative panels may be formed of any suitable clear material such as plastic, and may be constructed of Lexan® to provide high impact strength to withstand the ravages of vandalism. Also the single sheet, unitary nature of the panel construction allows for greater ease of on-site replacement of the panels.

Figure 4:
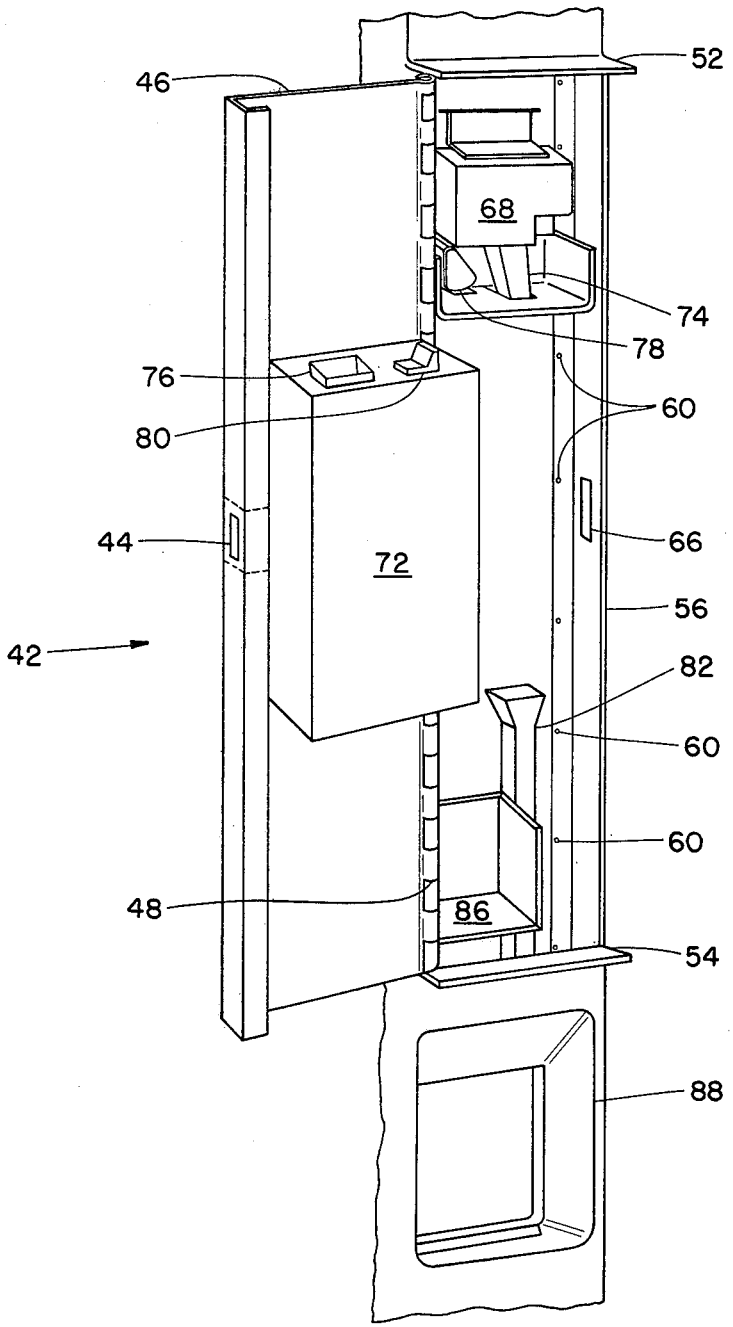
FIG. 4 is a fragmentary view of only the security pylon, with the rear panel thereof being opened to illustrate further details of its construction.

The side panels extend over substantially the full height and width of the sides of the machine, thereby providing maximum coverage of the side areas of the machine. In the event that a side of the machine is defaced or vandalized, a simple replacement of the decorative panel will repair and restore a pleasing aesthetic appearance to the machine. Each side panel is secured in place by a simple detachable frame consisting of top and bottom molding members 22 which overlap the top and bottom edges of the panel and side molding members 24 overlapping the side edges thereof. The detachable moldings 22 and 24 may be secured in place relative to the sheet metal side of the machine by small screws or bolts 26 which extend through holes in the sheet metal and engage threaded apertures provided in the frame members 22 and 24 outside the perimeter of the decorative panel, as illustrated in phantom FIG. 4. Accordingly, the moldings may be detached from the machine to release a decorative panel after the machine has been unlocked and opened by authorized service personnel.

Figure 2:
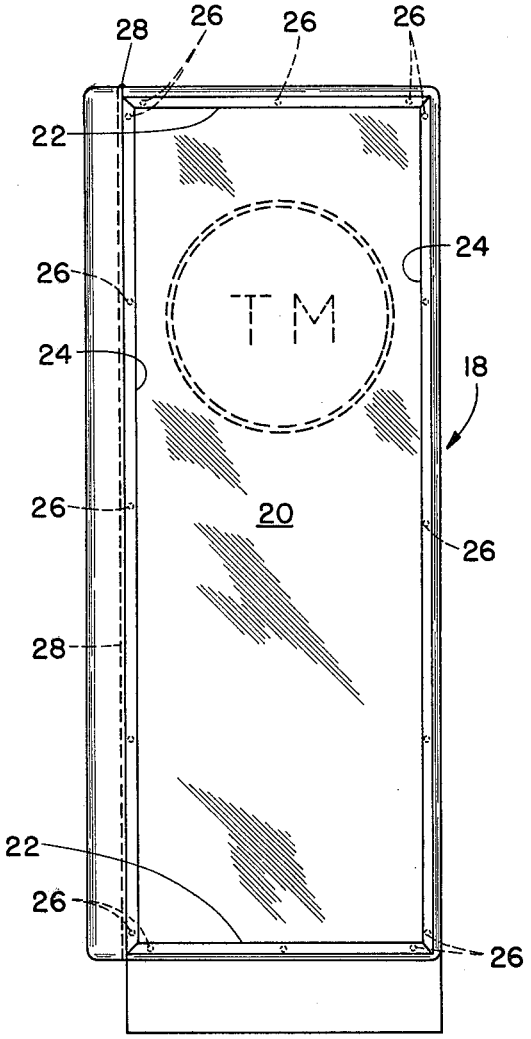
FIG. 2 illustrates a side view of the vending machine shown in FIG. 1.
Figure 3:
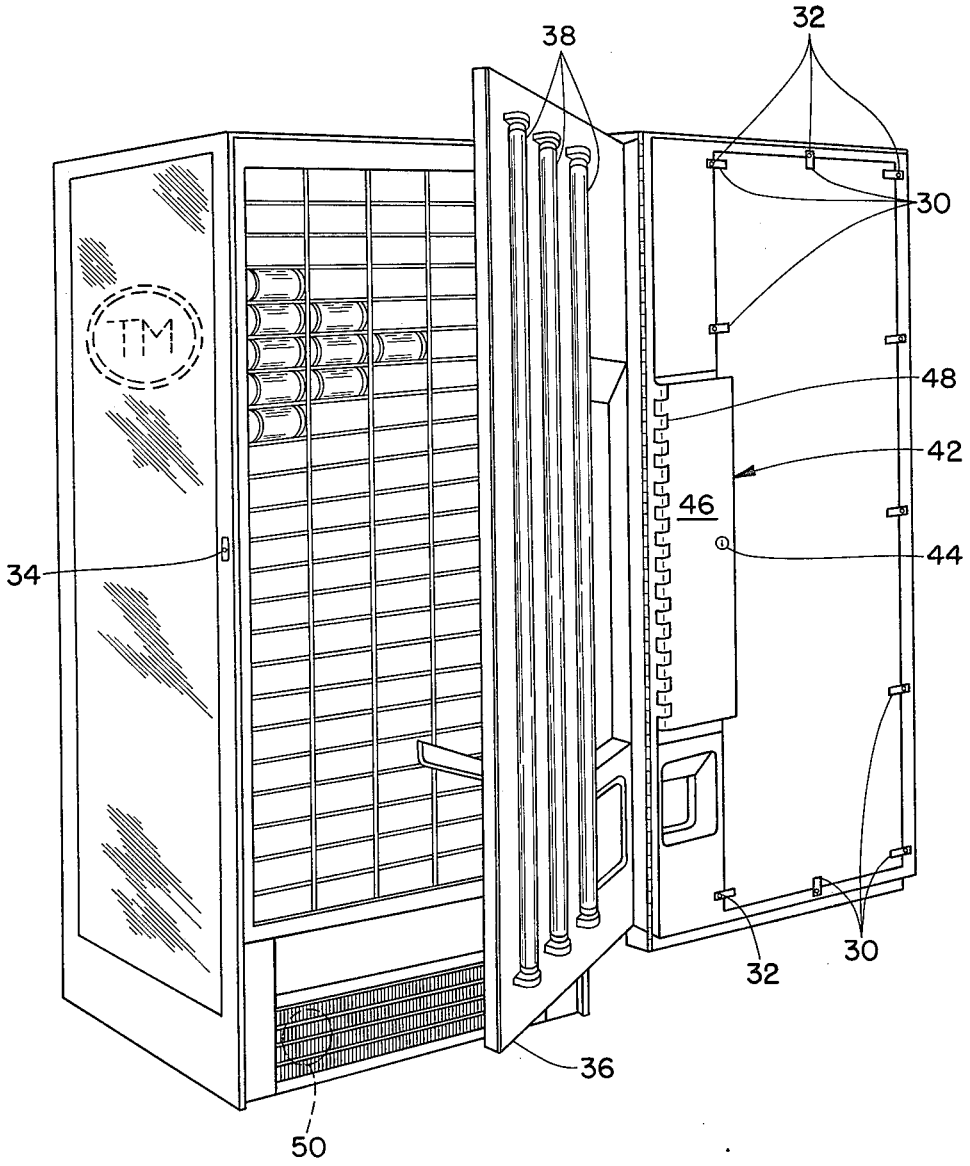
FIG. 3 is a frontal perspective view of the same vending machine with the front panel door fully opened, providing a view of the interior thereof.

The front sheet metal panel also forms a door for the vending machine which pivots about the right front corner of the machine by a piano hinge 28, illustrated in phantom in FIG. 2. A large rectangular opening is provided in the front sheet metal door to accomodate the positioning therein of the front decorative panel 20, which may be secured to the door by a plurality of clips 30. The clips 30 may be simply in the nature of the type of clips utilized to hold window or door screens or glass panels in place in storm windows and doors. A thumbscrew 32 on each retainer clip provides for easy removal of a clip when replacement of the front panel is desired. The removable clips 30 are accessible only when the vending machine is opened, and accordingly the front decorative panel 20, like the side panels, can only be removed by authorized personnel.

The common panel structure disclosed herein allows a service employee to perform many on site repairs to a vending machine to restore it to an acceptable aesthetic appearance while carrying a minimal number of spare parts and tools. One replacement panel may be used to provide repairs for three sides of the machine. Further, if a replacement panel is temporarily unavailable, and the front panel on the machine is defaced or mutilated, the front panel may be exchanged with one of the less visible side panels to temporarily improve the aesthetic appearance of the machine.

A lock 34 is provided on the exterior of the vending machine to unlock the front door when access to the interior of the machine is desired by service personnel. This lock may be of any suitable type such as one using interengaging rods and apertures at several positions around the perimeter of the front door.

As an optional feature of the present invention, a security and illumination panel 36 is provided immediately behind the front decorative panel 20. The illumination panel includes a plurality of vertically extending fluorescent lamps 38 to illuminate the front decorative panel from interiorly of the machine during nighttime hours. A photocell 40 may be provided, preferably on the front or top surface of the machine, to sense when ambient illumination falls below a given threshold to initiate illumination of the fluorescent lamps. Accordingly, the illumination is extinguished during daylight hours, thereby resulting in conservation of electrical power during daytime hours when illumination of the sign is not required. The illumination panel is constructed of sheet metal and provides security for the interior of the machine in the event that the front decorative panel is shattered, effectively precluding access to the interior of the vending machine by vandals or thieves. Illumination is provided only for the front panel of the machine, as the side panels are not illuminated internally. It is contemplated that some embodiments of the present invention will not be provided with an illumination panel. Embodiments of that nature may eliminate the back illumination panel entirely, and accordingly the large rectangular opening in the front door normally accomodating the front decorative panel may also be eliminated. In those embodiments the front decorative panel may be mounted over the continuous outer sheet metal surface of the front door by detachable moldings in a manner similar to that illustrated herein for the side panels.

The vending machine 10 includes security pylon 42 mounted on the back or interior surface of the front door panel. Access to the security pylon is provided by a second lock 44 which may be operable by a key which does not fit the first lock on the outer front door. By providing two different types of locks in the vending machine, only authorized personnel having both first and second keys, fitting respectively the outer and inner locks, may gain access to the cash receipt and cash dispensing functions maintained within the security pylon. A design of this nature allows selected types of personnel, such as a delivery employee, access to the interior of the machine to perform given functions therein, such as restocking and repair, while denying access to the cash in the machine. It also presents a second barrier to potential thieves who might pry open the front door with a crowbar or other instrument.

The rear panel 46 of the pylon is pivotably openable relative to the security pylon by a second piano hinge 48. Typically the security pylon is constructed of sheet steel, with the gauge of the sheet steel forming the security pylon being thicker than the gauge of the steel from which other portions of the vending machine are constructed.

Furthermore the vending machine may incorporate an audio and/or visual alarm 50 which is activated in the event that either the outer door or the security pylon is breached in an unauthorized fashion. The alarm may be designed with a power supply which is not interrupted in the event the vending machine is unplugged from an AC wall outlet. In this regard, the power supply may be a separate battery pack or a rechargable battery which is periodically recharged by the AC voltage supply to the machine. Triggering of an audio alarm by an unauthorized opening of the outer door of the vending machine is particularly advantageous as the alarm would discourage potential thieves from pursuing further attempts to open the security pylon while the audio alarm is sounding.

The visible sheet metal areas of the machine may be painted in a suitable color such as black with a textured finish to provide an aesthetically attractive machine.

Figure 5:
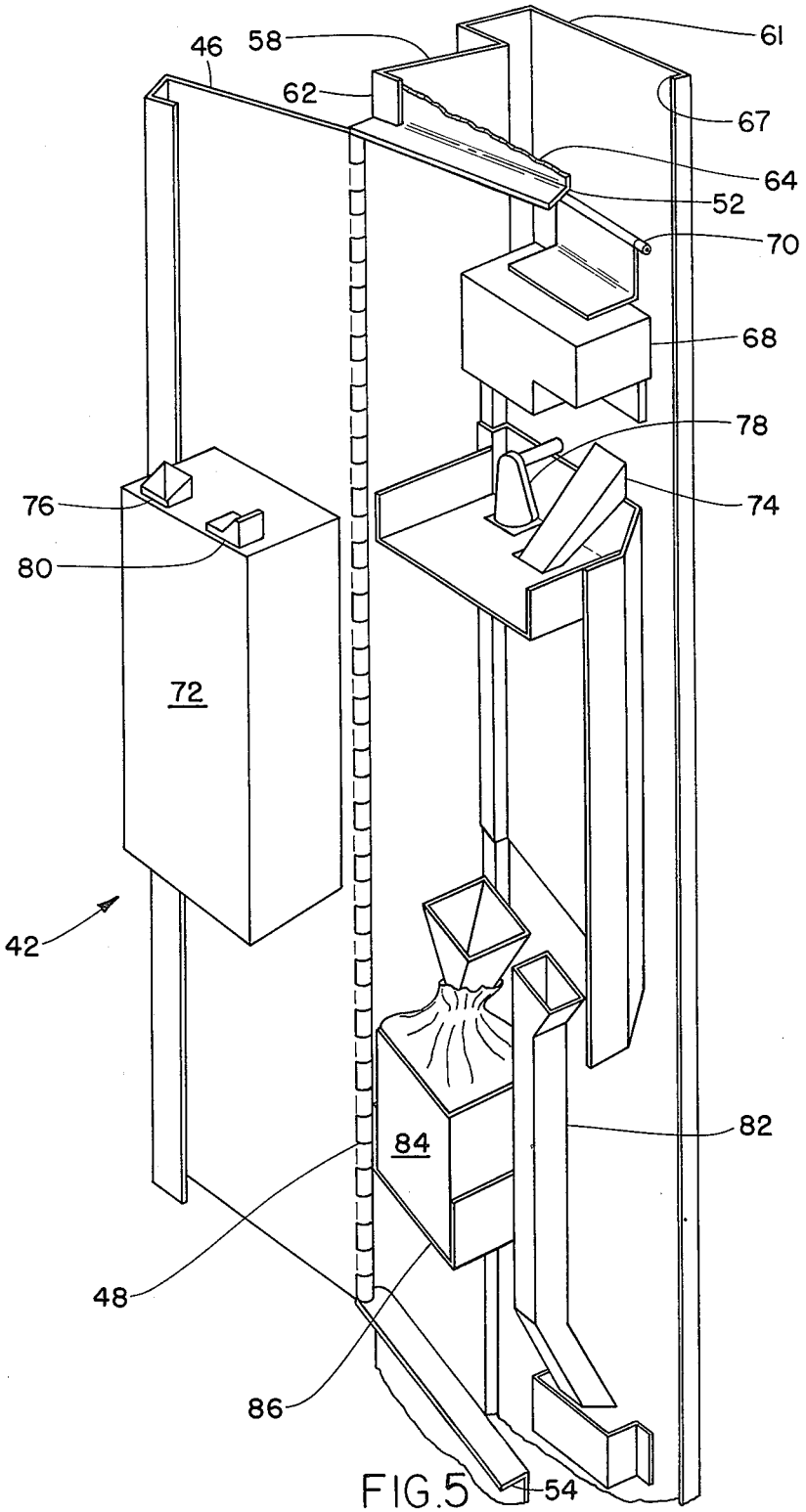
FIG. 5 is a second illustration of the security pylon in an opened state to illustrate other details of its construction.

The security pylon is constructed in a manner to prevent the leverage of a tool such as a crowbar acting to gain unauthorized access thereto. In this regard, case to door overlap is provided along the top and bottom edges of the door for the security pylon by top and bottom flanges 52 and 54 which extend along and effectively cover the top and bottom edges of the pylon door 46. The radially outermost edge of the door is bent back on itself in a U shape to provide a structurally reinforced outer edge, and the base of the U at the outermost edge of the door is effectively covered by the vertically extending sheet metal side 56 of the security pylon. As illustrated best in FIG. 5, one side 58 and the back surface 61 of the pylon are constructed from one unitary piece of sheet steel. The unitary sheet has a vertically extending flange 62 in the front thereof for connection to the sheet metal front 64 of the pylon and a vertically extending flange 67 in the rear thereof for connection to the sheet metal side 56, which may be attached thereto by rivets 60. The sheet metal side 56 includes a vertically extending slot 66 which cooperates with the pylon lock 44 to secure the pylon in a locked condition.

An instruction unit 68, which may include lights selectively illuminating instruction legends and seven segment digital displays, is pivotally mounted behind the front panel of the machine by a top hinge 70 to allow access to information, which may be in the form of cards, displayed at the front of the instruction unit.

A coin handling unit 72, which may be a standard commercially available unit, is mounted on the interior of the security pylon door. When the pylon door is in its closed position, the coin mechanism interfaces with: a coin chute 74 extending from the coin depositing slot in the front panel of the machine to a coin depositing opening 76 in the top of the coin handling mechanism; a coin return toggle cam 78 which is rotationally mounted relative to the front panel such that rotation of the coin return knob causes rotation of the toggle cam and results in actuation of a toggle mechanism 80 to initiate the coin return function of the coin handling unit; a coin return chute 82 extending from the bottom of the coin handling unit to a change hopper on the front panel; and a money box 84 positioned beneath the coin handling unit in a coin box 86.

The front door of the machine also includes a product dispensing chute 88 extending therethrough beneath the security pylon to provide for the passage of soft drink containers to the container dispensing opening on the front panel of the machine.

While one embodiment of an improved and more secure design for a vending machine has been disclosed herein, it should be apparent that the teachings of the present invention will suggest other embodiments and different variations to one of ordinary skill in the art.

What is claimed is:

1. A vending machine providing for the storage of cash receipts of the machine in a security pylon therein, comprising:

a. a vending machine having a front outer door formed as part of the front exterior panel of the vending machine to allow access to the interior of the machine for service operations, and a first lock for said outer door to prevent unauthorized access to the interior of the machine; and b. a security pylon mounted behind and on the interior of the front outer door of the vending machine for storage of the cash receipts of the vending machine, and the rear panel of the security pylon having a second lock for said security pylon, whereby the cash receipts of the vending machine may be removed only after successively opening said first and second locks, said rear panel of the security pylon being pivotably mounted on one side relative to the security pylon, a coin handling unit mounted on the inside surface of said rear panel and being pivotably movable therewith, a coin chute and coin return toggle mechanism mounted in the security pylon on the interior of the front outer door and above the coin handling unit when said rear panel is closed and cooperating therewith respectively to deposit coins therein and actuate the coin return function of the coin handling unit, and a coin return chute and coin collection depository mounted in the security pylon on the interior of the front outer door and below the coin handling unit when said rear panel is closed and cooperating therewith respectively to return coins to a change hopper on the front panel of the vending machine and to accumulate the cash receipts thereof.

2. A vending machine as claimed in claim 1, said first lock being openable by a first type of key which does not fit said second lock.

3. A vending machine as claimed in claim 1, said security pylon being positioned laterally off to one side of the front wall of said vending machine.

4. A vending machine as claimed in claim 1, said vending machine and security pylon both being constructed of sheet steel, with the gauge of the sheet steel forming the security pylon being thicker than the gauge of the steel from which other portions of the vending machine are constructed.

5. A vending machine as claimed in claim 1, further including an audio alarm which is actuated in the event that said outer door is opened in an unauthorized fashion.

6. A vending machine as claimed in claim 1, said front panel being pivotable relative to the machine by a first piano hinge, and said rear panel of the security pylon being pivotable relative to the pylon by a second piano hinge.

7. A vending machine as claimed in claim 1, said security pylon being provided with case to door overlap along the top and bottom edges of said rear panel of the pylon.

* * * * *